United States Patent [19]

d'Alquen

[11] 4,388,801

[45] Jun. 21, 1983

[54] PROCESS AND APPARATUS FOR PRODUCING A TWISTED ELASTIC THREAD

[75] Inventor: Gunter d'Alquen, Monchen-Gladbach, Fed. Rep. of Germany

[73] Assignee: Krall & Roth, Weberei GmbH & Co., K.G., Mönchen-Gladbach, Fed. Rep. of Germany

[21] Appl. No.: 250,016

[22] Filed: Apr. 1, 1981

[30] Foreign Application Priority Data

Apr. 2, 1980 [DE] Fed. Rep. of Germany ..... 3012753

[51] Int. Cl.[3] ..... D01H 13/10; D01H 1/26; D01H 1/30

[52] U.S. Cl. ..... 57/12; 57/6; 57/78; 57/93; 57/97; 57/264

[58] Field of Search ..... 57/3, 6, 7, 12, 13, 57/19, 264, 282, 292, 295–297, 309, 310, 314, 317, 82, 90, 92, 93, 97, 78

[56] References Cited

U.S. PATENT DOCUMENTS

| | | | |
|---|---|---|---|
| 2,310,951 | 2/1943 | Greene | 57/12 X |
| 3,099,126 | 7/1963 | Laureti | 57/90 X |
| 3,460,338 | 8/1969 | Morrison | 57/12 |
| 3,489,368 | 1/1970 | Rehwald | 57/12 X |
| 4,028,874 | 6/1977 | Magg et al. | 57/3 X |
| 4,276,739 | 7/1981 | Kempf et al. | 57/93 X |
| 4,288,977 | 9/1981 | Csaky et al. | 57/297 |

*Primary Examiner*—Donald Watkins

*Attorney, Agent, or Firm*—Irving M. Weiner; Pamela S. Burt; John L. Shortley

[57] ABSTRACT

A process and apparatus for producing a twisted elastic thread in which an elastomeric thread of substantially 154 dtex to 310 dtex, is adhesively twisted with two yarns. The thickness of each of the two yarns is substantially of 100 to 12,500 dtex, and the yarns preferably are OE yarns of polyvinyl chloride, polyvinyl cyanide, polyacrylonitrile and/or wool threads, preferably produced by the rotor process. Prior to twisting, the yarns are surface-swelled under a vacuum between substantialy 0.1 and 0.2 bar in superheated steam at substantially 70° C. for up to ten minutes for loosening purposes. During twisting, a pre-tension is imparted to the elastomeric thread with respect to the yarns. Such pre-tension is imparted to the elastomeric thread only a predetermined time after starting the twister, and the elastomeric thread is pre-tensioned by substantially 2 to substantially 5 times compared with the yarns.

6 Claims, 1 Drawing Figure

PROCESS AND APPARATUS FOR PRODUCING A TWISTED ELASTIC THREAD

BACKGROUND OF THE INVENTION

1. Field of the Invention

The invention relates to a process for producing a twisted elastic thread in which an elastomeric thread of approximately 154 dtex to 310 dtex is adhesively twisted with two yarns. The thickness of which is in each case approximately of 100 to 12,500 dtex. The yarns preferably are OE yarns of polyvinyl chloride, polyvinyl cyanide, polyacrylonitrile and/or wool threads, preferably produced by the rotor process and prior to twisting the yarns are surface-swelled under a vacuum between approximately 0.1 and 0.2 bar in superheated steam at approximately 70° C. for up to ten minutes for loosening purposes, and while twisting is being performed a pre-tension is imparted to the elastomeric thread with respect to the yarns.

2. Description of Relevant Art

Twisted elastic threads generally comprise an elastomeric thread and two yarns of natural or synthetic fibers, which hide this generally undyed elastomeric thread. It was hitherto difficult to produce the elastic twisted threads from inexpensive OE yarns and an elastomeric thread. Thus, OE yarns are produced by the rotor process, are very hard and have an approximately circular cross-section. Such circular yarns do not tend to adhere to the elastomeric thread surface or to remain in the initially occupied position during the stretching apart and drawing together of the elastomeric thread. Instead they slide backwards and forwards on the elastomeric thread, leading after a certain time to the extremely undesired "grinning through" of the not dyed and generally whitish elastomeric thread. Therefore U.S. Pat. No. 2,146,966 proposes adhesion to the elastomeric fiber of yarns which do not automatically adhere thereto with the aid of a suitable, e.g., heat-activatable adhesive. To this end, prior to twisting, the elastomeric thread is provided with a heat-activatable adhesive, is twisted, and after the twisting process is activated by a heat treatment, so that the yarns firmly adhere to the elastomeric thread. Thus, this process always requires adhesive-impregnated yarns which, under certain circumstances, can have unpleasant characteristics, e.g., in the long run the adhesive can change colors, is expensive, in some cases leads to allergies and, particularly at elevated temperatures undesirably reacts with free valencies of man-made fibers.

Thus, DOS 28 11 329 provides an improved process of the present type in which by using yarns roughened and swelled by using steam and which more readily adhere to the elastomeric thread, a good connection with the latter can be ensured without it being necessary to use expensive adhesives, which have a disadvantageous influence on the product quality. The elastomeric thread is preferably twisted under an approximately 3.5 times pre-tension.

It has now been found that in the production of such twisted threads, thread breaks frequently occur when starting and stopping the twister, particularly if a machine must momentarily be switched off while replacing reels or the like.

The problem overcome by the present invention is to prevent such thread breaks during the starting phase of the twister, while retaining the advantages of the process of DOS 28 11 329 and permitting increased productivity with reduced down times.

SUMMARY OF THE INVENTION

According to the invention the aforesaid problem is solved in that the tension of the elastomeric thread on starting the twister is approximately the same as the tension of the yarns and only at a predetermined time after starting the twister is the elastomeric thread pre-tensioned by approximately 2 to approximately 5 times compared with the yarns.

The apparatus proposed by the invention for performing the aforesaid process is characterized in that two gears with different transmission ratios are provided for transmitting the torque of a driving shaft to the delivery and pressure roller of a twister. One gear having a transmission ratio giving approximately the same delivery speed for the yarn and elastomeric threads on switching on the twister is connected via a coupling on the driving shaft and after a certain time is disconnected, while the other gear leading to an approximately 2 to 5 times lower delivery speed of the elastomeric thread as compared with the yarns is simultaneously coupled in.

Due to the fact that the pre-tension is only built up after starting the apparatus, it is possible to ensure that the elastomeric thread is not strained in the starting phase or that the yarn threads are not suddenly so highly loaded during starting that they break.

Further features and advantages of the invention can be gathered from the claims and the following description.

DETAILED DESCRIPTION OF PREFERRED EMBODIMENTS

Figure 1:
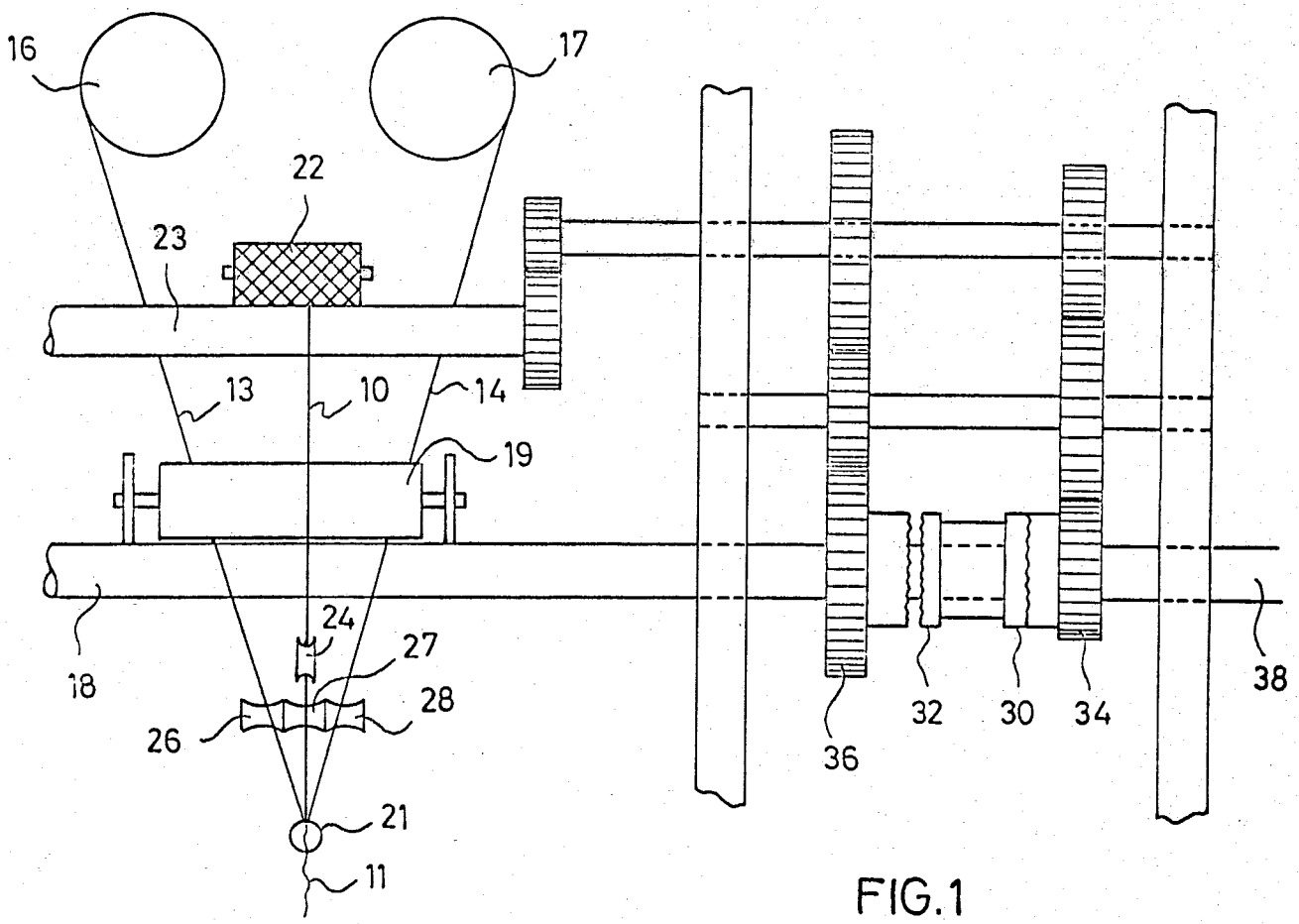
FIG. 1 depicts a diagrammatic view of an apparatus for performing the process in accordance with the present invention.

With reference to FIG. 1, in the process of the invention a twisted elastic thread 11 is formed from an elastomeric thread 10 and two yarns, preferably OE yarns, although the invention is generally directed to the production of elastomeric threads. As described in DOS 28 11 329 and as shown in FIG. 1, the three threads are aligned substantially in parallel via a deflection pulley 24 for the elastomeric thread or guide pulleys 26, 27, 28, and are twisted in a twisting ring 21. The non-elastic yarns 13 and 14 are removed from their reels 16, 17 by the interaction of a pressure roller 19, which can if necessary rest on the delivery roller 18. The yarn delivery speed is determined by the rotary speed of the delivery roller 18. Elastomeric thread 10 is removed, without pre-tension, from its supply reel 22, the elastomeric thread pre-tension depending on the rotary speed of delivery roller 23. Delivery roller 23 and delivery roller 18 are driven by a common driving shaft 38, the particular rotation speeds being regulated by means of transmission gears 34, 36.

FIG. 1 shows two different transmissions, the first, which is effected by gear 34 which, in the represented operation has just been coupled in and is therefore effective, leading to an approximately 1:1 delivery speed of elastomeric thread and yarns. Thus, the elastomeric thread is not pre-tensioned relative to the yarns. The other transmission, shown in the drawing as a non-coupled gear 36 leads to the elastomeric thread being pre-tensioned approximately 2 to approximately 5 times, through delivery roller 23 rotating more slowly than delivery roller 18.

The apparatus for performing the process of the invention is started, in the following way. On starting the first coupling 30 is coupled in, as shown in the drawing, so that the torque of driving shaft 38 in the case of an approximately 1:1 transmission ratio leads to approximately identical delivery speeds for the elastic yarn and the OE yarn. After a predetermined time, which may be established by an electrical timing circuit or similar well known device, the second coupling 32 is connected and simultaneously coupling 30 is disconnected, so that the torque of driving shaft 38 now acts via gear 36. The elastomeric thread is then pre-tensioned approximately 2 to 5 times and preferably 3.5 times compared with the inelastic yarn threads.

It obviously falls within the scope of the invention to replace the electric coupling by mechanical couplings, which can be manually operated in a random manner. However, the couplings are preferably coupled in such a way that only one coupling can be engaged and operates.

The inventive features disclosed in the description, drawing and claims can individually or in random combination be essential to the realization of the various embodiments of the invention.

I claim:

1. A process for producing a twisted elastic thread wherein an elastomeric thread is adhesively twisted with two OE yarns, said yarns comprising yarns such as OE yarns of polyvinyl chloride, polyvinyl cyanide, polyacrylonitrile and/or wool threads produced by a process such as a rotor process, comprising the steps of:

surface-swelling said yarns under a vacuum between substantially 0.1 to 0.2 bar in superheated steam at substantially 70° C. for up to substantially ten minutes for loosening purposes, prior to twisting said yarns;

pre-tensioning said elastomeric thread with respect to said yarns such that the tension of said elastomeric thread is substantially the same as the tension of said yarns upon starting a twister; and a predetermined time after starting said twister, pre-tensioning said elastomeric thread by substantially 2 to substantially 5 times compared with said yarns.

2. A process according to claim 1, wherein:

said elastomeric thread has a thickness of substantially 154 to 310 dtex; and said two OE yarns each have a thickness of substantially 100 to 12,500 dtex.

3. A process according to claim 1 or 2, wherein:

said predetermined time after starting said twister comprises substantially four seconds.

4. An apparatus for producing a twisted elastic thread wherein an elastomeric thread is adhesively twisted with two OE yarns, said yarns comprising surface-swelled yarns such as OE yarns of polyvinyl chloride, polyvinyl cyanide, polyacrylonitrile and/or wool threads, comprising:

a twister including a delivery roller for applying tension to said elastomeric thread and a pressure roller for applying tension to said yarns, said rollers having a common driving shaft operably connected therewith;

said driving shaft being provided with first and second couplings;

first and second gears with different transmission ratios being alternatively operably connected between said rollers and said first and second couplings of said driving shaft, respectively, so as to transmit the torque of said driving shaft to said delivery roller and said pressure roller;

said first gear having a transmission ratio which provides substantially the same delivery speed for said elastomeric thread via said delivery roller and said yarns via said pressure roller;

said second gear having a transmission ratio which provides substantially a 2 to 5 times lower delivery speed of said elastomeric thread via said delivery roller as compared with that of said yarns via said pressure roller;

said first gear being connected with said driving shaft via said first coupling upon starting said twister; and means for disconnecting said first gear from said first coupling and for simultaneously connecting said second gear with said second coupling at a predetermined time after starting said twister.

5. An apparatus according to claim 4, wherein:

said predetermined time after starting said twister comprises substantially four seconds.

6. An apparatus according to claim 4 or 5, wherein:

said first and second couplings comprise electric couplings.

* * * * *